US005205350A

United States Patent [19]

Hirsch et al.

[11] Patent Number: 5,205,350

[45] Date of Patent: Apr. 27, 1993

[54] PROCESS FOR COOLING A HOT PROCESS GAS

[75] Inventors: Martin Hirsch, Friedrichsdorf; Wolfgang Frank, Eschborn; Manfred Heil, Obermörlen, all of Fed. Rep. of Germany

[73] Assignee: Metallgesellschaft AG, Frankfurt am Main, Fed. Rep. of Germany

[21] Appl. No.: 731,490

[22] Filed: Jul. 17, 1991

[30] Foreign Application Priority Data

Jul. 20, 1990 [DE] Fed. Rep. of Germany ..... 4023060

[51] Int. Cl.[5] ..... F28C 3/16

[52] U.S. Cl. ..... 165/104.18; 165/104.16; 122/4 D

[58] Field of Search ..... 165/104.16, 104.18; 122/4 D

[56] References Cited

U.S. PATENT DOCUMENTS

| | | | |
|---|---|---|---|
| 3,977,846 | 8/1976 | Russel et al. | 55/390 |
| 4,120,668 | 10/1978 | Fraley | 55/269 |
| 4,483,276 | 11/1984 | Lomas et al. | 165/104.18 |
| 5,005,528 | 4/1991 | Virr | 122/4 D |

FOREIGN PATENT DOCUMENTS

| | | | |
|---|---|---|---|
| 3439600 | 6/1988 | Fed. Rep. of Germany . | |
| 1259787 | 3/1961 | France | 122/4 D |
| 95193 | 6/1983 | Japan | 165/104.16 |
| 00009 | 1/1979 | PCT Int'l Appl. . | |
| 08741 | 11/1988 | PCT Int'l Appl. . | |
| 2191715 | 12/1987 | United Kingdom . | |

*Primary Examiner*—Albert W. Davis, Jr.
*Attorney, Agent, or Firm*—Felfe & Lynch

[57] ABSTRACT

Disclosed is a process for cooling hot exhaust gases. The process gases are supplied to a stationary fluidized bed, which contains cooling elements and is contained in an annular trough. Fluidizing gas is supplied to the stationary fluidized bed through the permeable bottom of the trough. The hot process gas is passed through the central opening in the fluidized bed. Cooled solids flow from the fluidized bed across the inner rim of the trough into the process gas stream and are entrained by said stream into the dust-containing space over the top surface of the fluidized bed. The solids which are separated in the dust-containing space fall back into the annular fluidized bed, and the cooled gas which contains the remaining solids is supplied to a gas cooler, which is provided with cooling surfaces. The gas which leaves the upper portion of the gas cooler is fed to a solids separator and the separated solids are recycled to the stationary fluidized bed.

19 Claims, 1 Drawing Sheet

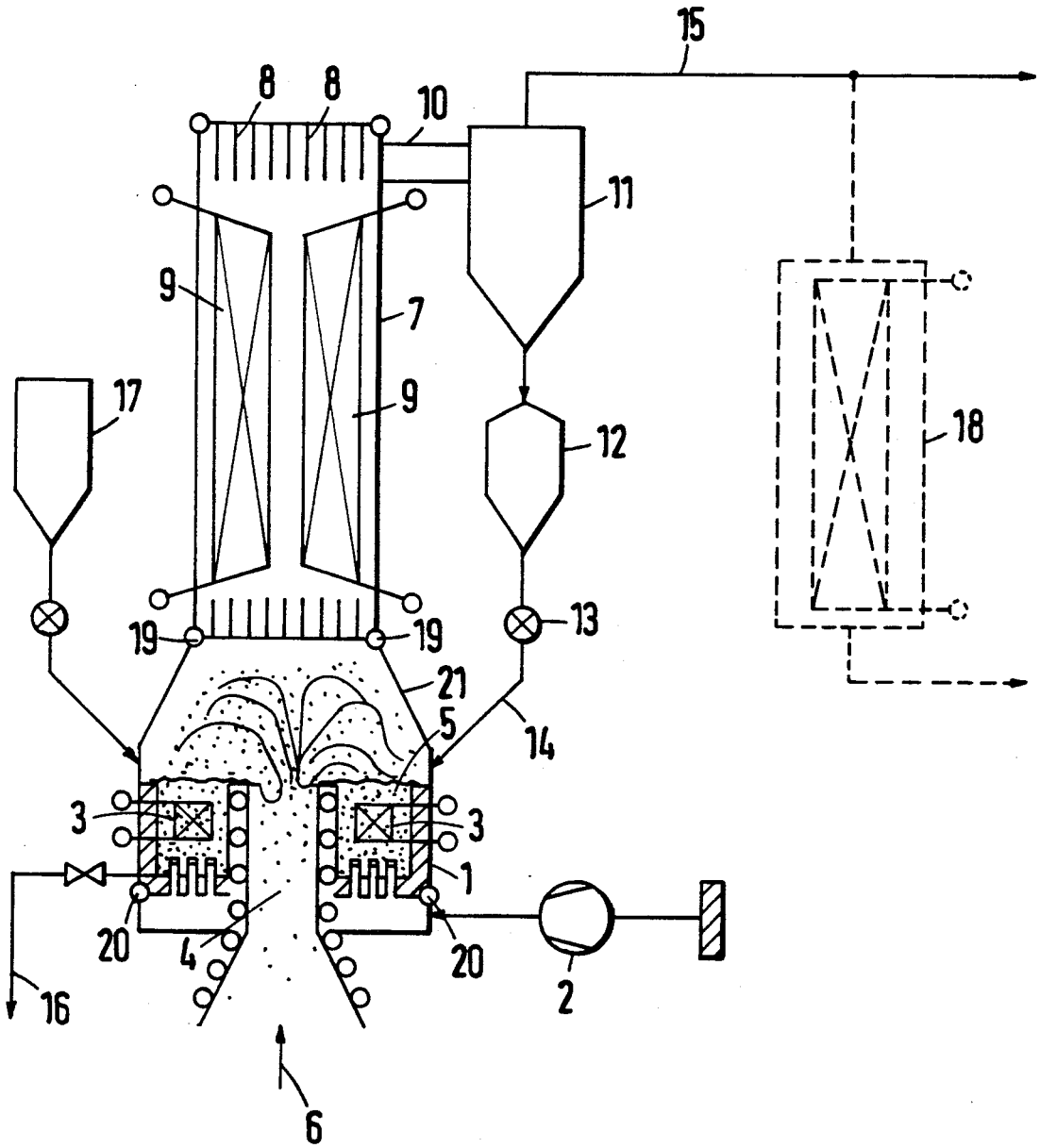
15
8
8
10
11
9
7
9
17
12
18
13
19
19
21
5
14
3
3
1
20
20
4
2
16
6

PROCESS FOR COOLING A HOT PROCESS GAS

BACKGROUND OF THE INVENTION

The present invention is in a process for cooling a hot process gas in which the gas is fed through a stationary fluidized bed, which contains cooling elements, part of the solids suspended in the gas stream are separated in the dust-containing space over the fluidized bed and are recycled to the fluidized bed. The solids separated from the exhaust gas in a deduster are recycled to the fluidized bed.

In some processes, a hot process gas is formed which can be cooled only with considerable difficulty. For instance, a process gas may contain condensable components or entrained liquid droplets, e.g., of metal or slag. Such condensable components or entrained liquid droplets may form crusts on cooling surfaces when the gas is cooled. The process gas may contain poorly flowing fine dusts, which may form crusts even at the temperature of the process gas or when cooled. The process gases may also contain $SO_3$, or $SO_3$ may be formed in response to a cooling, or an undesired sulfatizing may occur.

German Patent Specification 34 39 600 discloses that a process gas formed by the gasification of carbonaceous solids can be cooled by supplying the hot process gas to, and cooling the gas in, a stationary fluidized bed of sulfur-binding solids. The fluidized bed contains cooling elements through which a cooling fluid passes. The fluidizing gas consists of a recycled partial stream of the process gas exhausted from the fluidized bed. The process gas is introduced into the fluidized bed from the side or from above. The cooled process gas, which has left the fluidized bed, is dedusted in a cyclone, cooled further in a heat exchanger, and introduced into a gas purifier. The solids removed in the cyclone and in the gas purifier are recycled to the fluidized bed. This procedure does not avoid contact between the process gas and cooling surfaces so that crusts may be formed. An optimum mixing of the process gas and solids is not achieved.

U.S. Pat. No. 3,977,846 discloses that a process gas, which contains hydrocarbons, can be cooled in a stationary fluidized bed which, in its lower portion, contains cooling surfaces through which a cooling fluid passes. The fluidizing gas consists of an extraneous gas which is free of hydrocarbons. The process gas is introduced above the cooling surfaces through nozzles, which are disposed in the fluidized bed. The nozzles are heat-insulated to prevent the formation of deposits. The cooled process gas leaving the fluidized bed is supplied to a deduster. Solids laden with condensed hydrocarbons are withdrawn from the fluidized bed and fresh solids are charged into the fluidized bed. One must expect a clogging and high wear of the nozzles by the corrosive components and solids contained in the process gas.

U.S. Pat. No. 4,120,668 discloses that a process gas which contains molten salt particles and volatile components can be cooled in a stationary fluidized bed, into which the process gas is introduced as a fluidizing gas. The fluidized bed contains cooling surfaces above the level at which the process gas is introduced. The cooled gas is dedusted in a cyclone, and the removed solids are recycled to the fluidized bed. Part of the solids are downwardly removed from the fluidized bed, and fresh solids are charged into the fluidized bed. In that case the above-mentioned disadvantages will also be encountered.

WO 88/08741 refers to a process wherein a process gas is cooled in a circulating fluidized bed. In that technique the process gas is cooled in a mixing chamber with cooled process gas which is recirculated and with cooled solids which are recirculated. The bottom of the mixing chamber is conical and has an opening for receiving the process gas and the recirculated gas. The suspension leaving the mixing chamber can be cooled further on cooling surfaces in the upper portion of the bed vessel and the solids may subsequently be removed in cyclones and be recycled to the bed vessel. A partial stream of the gas may be recirculated to the bed vessel. Alternatively, the suspension may be discharged without further cooling and the solids may be removed in cyclones and be recycled to the bed vessel, whereafter the gas may be cooled and may be partially recirculated to the vessel. The density of the suspension in the circulating fluidized bed is maintained at 1 to 5 $kg/m^3$ or lower values and the solids are recycled at a rate of 0.92 to 11.5 $kg/sm^3$ ($sm^3$= standard cubic meter). The large volume of the exhaust gas is due to the high rate of gas recycle and requires an expensive gas purifier. A relatively large heat exchange surface area is required due to the low density of the suspension.

SUMMARY OF THE INVENTION

It is an object of the invention to economically and efficiently cool hot process gases and avoid formation of crusts and sulfates.

That object and others are accomplished in accordance with the invention in that a stationary fluidized bed is provided, which contains cooling elements and is contained in a first space such as an annular trough. A fluidizing gas is fed to the fluidized bed through the gas-permeable bottom of the trough. The inflowing process gas is passed through an opening of the fluidized bed vessel which is preferably a central opening. Cooled solids from the bed flow over the inner rim of the trough into the process gas stream where they are entrained in the stream and carried into the dust-containing space over the top surface of the fluidized bed. The solids removed in the dust-containing space fall back into the fluidized bed and, the cooled gas, which contains the remaining solids, is fed to a gas cooler comprised of cooling surfaces. The gas leaving the upper portion of the gas cooler is fed to a solids separator and removed solids are recycled to the stationary fluidized bed.

The stationary fluidized bed exhibits a distinct density step between the dense phase and the overlying dust-containing space. The stationary fluidized bed may be circular, rectangular or polygonal.

The cooling surfaces contained in the fluidized bed are suitably replaceably mounted and may be connected to constitute evaporators and/or superheaters. Such cooling surfaces are generally formed as tube banks.

The walls of the trough are provided with cooling pipes. The inner wall of the trough defines the central opening in the fluidized bed. The cooled solids flow from the stationary fluidized bed across the rim of the inner wall of the trough into the opening and are admixed with the process gas stream. The cooled overflowing solids are entrained thereby as a dense suspension in a central jet into the dust-containing space above the fluidized bed so that the process gas is rapidly cooled to a large extent.

Due to the increase of volume in the dust-containing space, a major part of the entrained solids will be removed in the dust-containing space and will fall back into the stationary fluidized bed where the solids are recooled. The cooling of the process gas to the temperature which is desired in the dust-containing space is obtained in that the solids are suitably cooled in the stationary fluidized bed and in that solids, at a suitable rate, are caused to flow into the hot process gas stream. The wall defining the dust-containing space is cooled by cooling pipes. The mixed gases which consist of process gas and fluidized gas, and which contain the remaining solids, are fed to a gas cooler for additional cooling. The gas cooler is preferably disposed over the dust-containing space and has cooled walls but may also be provided with suspended cooling surfaces. The cooling fluid generally consists of water and the gas cooler may be connected to constitute an evaporator. Part of the solids which are still suspended in the gas are removed in the gas cooler, fall into the dust-containing space and further back into the stationary fluidized bed.

The cooled gas from the gas cooler section has a low content of remaining solids and is fed to a solids separator, consisting, e.g., of a cyclone, filter, or gas-purifying electrostatic precipitator wherein the gas is substantially cleaned by removal of the solids. The gas is then discharged as an exhaust gas or fed to a further gas purifier.

All or part of the solids removed in the separator are recycled to the stationary fluidized bed. In dependence on the composition of the process gas, part of the solids are removed from the process and are replaced by fresh solids. This will prevent an excessive enriching of the separated substances in the solids.

The fluidizing gas may consist of any gas which will not disturb the cooling or succeeding processes. If air is required for the further processing of the exhaust gas, e.g., in the processing of gases having a high $SO_2$ content, or if air is not disturbing in such further processing, air may be used as a fluidizing gas. Otherwise a portion of the exhaust gas may be recirculated, provided that the recirculated exhaust gas is previously purified to remove substances which would damage the permeable bottom. To minimize the rate of fluidizing gas, the particle size of the solids in the fluidized bed is suitably less than 1 mm with a median value ($d_{50}$) below 0.5 mm.

According to a preferred embodiment of the invention the suspension in the stationary fluidized bed has a density of 300 to 1500 kg/m$^3$ of the empty volume of the trough, preferably of 500 to 1000 kg/m$^3$. Particularly good operating conditions are achieved in said ranges because heat transfer in the stationary fluidized bed will be high.

In another preferred embodiment, solids at a rate of 1 to 10 kg/sm$^3$, preferably 2.5 to 6 kg/sm$^3$, are supplied from the stationary fluidized bed to the process gas stream. Within said range the process gas is rapidly cooled as desired without the need for a very large amount of cooling surface.

In another preferred embodiment the gas leaving the upper portion of the gas cooler has a solids content of 0.1 to 1 kg, preferably 0.2 to 0.6 kg/sm$^3$. The pressure drop in the gas cooler is relatively low and the gas is effectively cooled under such conditions.

Preferably, the volume rate (sm$^3$/min) of the fluidizing gas which enters the stationary fluidized bed through the permeable bottom is 10 to 30%, preferably 15 to 20%, of the volume rate (sm$^3$/min) of the process gas. As a result, the energy requirement for the fluidizing gas is relatively low and if the exhaust gas is recycled the costs of the required gas purifier are reduced.

According to a preferred feature, the solids removed in the separator are recycled at a controlled rate to the stationary fluidized bed. The solids are not removed in the separator at a constant rate. In case of a direct, uncontrolled recycling the varying rate may be a cause of poor results, which will be avoided by a controlled recycling at a uniform rate.

To assist in controlling the solids recycle rate, a vessel is interconnected between the separator and the recycling line in the fluidized bed. This vessel serves as a buffer and allows solids to be withdrawn therefrom at a controlled rate. The solids are suitably slightly fluidized in the interconnected vessel.

According to a preferred embodiment the process gas enters the stationary fluidized bed vessel through a central opening which preferably is insulated by a refractory lining. The central opening is defined by a sheet metal shell, which is provided on the outside with cooling surfaces. A refractory lining is mounted on the inside surface of the sheet metal shell so that formation of crusts consisting of solidified components of the process gas is avoided. Any molten components which are contained in the process gas and deposited on the lining will flow back into the fluidized bed.

According to a preferred feature the solids used to form the fluidized bed are suitable for further processing with any materials which have been removed from the exhaust gas.

The various features of novelty which characterize the invention are pointed out with particularity in the claims annexed to and forming a part of this specification. For a better understanding of the invention, its operating advantages and specific objects obtained by its use, reference should be had to the accompanying drawing and descriptive matter in which there is illustrated and described a preferred embodiment of the invention.

BRIEF DESCRIPTION OF THE DRAWING

The schematic drawing is a longitudinal sectional view showing a cooling system for carrying out the process of the invention.

DESCRIPTION OF PREFERRED EMBODIMENT

A fluidizing gas is blown by the fan 2 through a permeable bottom into an annular trough 1, which contains cooling elements 3. The inner wall of the trough 1 defines a central duct 4 through which a process gas is introduced.

The trough 1 contains a stationary fluidized bed 5, from which solids, due to the fluidizing gas, flow across the inner rim of the trough 1 into the process gas stream 6 in duct 4. The solids are admixed in the stream 6 to form a dense suspension, whereby the process gas is rapidly cooled to a large extent at the same time. That suspension is blown as a central jet into the dust-containing space 21, in which, due to the increased cross section and the resulting decrease of gas velocity, a major part of the solids are separated from the gas and fall back into the fluidized bed 5. The gas, which contains remaining solids, flows into the gas cooler 7, which is provided with schematically shown continuous wall-cooling means 8 and suspended cooling surfaces 9.

The cooled gas further flows through the outlet 10 into the cyclone 11. The dedusted gas is discharged through line 15. The gas may be cooled further in the cooler 18, which may be used, e.g., for feed water heating.

The solids separated in cyclone 11 fall into the interconnected vessel 12, which serves as a buffer. Solids at a controlled rate are recycled to the fluidized bed 5 by the discharge means, such as a valve 13, through the line 14. A portion of the solids are withdrawn from the fluidized bed through line 16. Fresh solids from bin 17 may be fed to the fluidized bed to start the process and to maintain a predetermined bed height.

The cooling elements for cooling the outer wall of the trough 1 and the wall which defines the dust-containing space 21 are only schematically indicated by the upper tubes 19 and the lower tubes 20.

EXAMPLE

The exhaust gas to be cooled has been formed by the smelting of lead ore in a QSL reactor. The exhaust gas becomes available at a temperature of 1010° to 1050° C. and at a rate of 21,800 $sm^3/h$ and contains 215 g dust per $sm^3$. The composition is

| | |
|---|---|
| 10.80% | $SO_2$ |
| 15.67% | $CO_2$ |
| 25.90% | $H_2O$ |
| 7.83% | $O_2$ |
| 39.80% | $N_2$ |

The exhaust gas is blown through the duct 4, which is 100 cm in diameter. Air at a temperature of 60° C. and under a pressure of 250 mbars is blown at a rate of 5000 $sm^3/h$ through the permeable bottom of the trough 1 into the stationary fluidized bed, which contains cooling tube banks 3 having a surface area of 42 $m^2$.

Cooled solids at a temperature of about 480° C. flow from the trough 1 into the duct 4 at such a rate that the process gas contains about 5 kg solids per $sm^3$. 5.27 MW heat are supplied by the exhaust gas, and about 3.78 MW of said heat are transferred to the cooling tube banks in the fluidized bed.

At a temperature of 600° C. the cooled exhaust gas enters at a velocity of 5.5 m/s the gas cooler 7, which has a cooling surface area of 250 $m^2$. The further cooled exhaust gas leaving the gas cooler 7 through the outlet 10 at a velocity of 4 m/s is at a temperature of 350° C. and contains 0.5 kg dust per $sm^3$. The gas which is withdrawn through line 15 from the cyclone 11 contains 5 to 10 g dust per $sm^3$.

Solids at a temperature of 350° C. are recycled from the interconnected container 12 to the fluidized bed 5 at a rate of 13,400 kg/h. Solids are withdrawn from the fluidized bed 5 through line 16 at a rate of 4,500 kg/h. Steam at 40 bars and 250° C. is generated at a rate of 12,100 kg/h. Solids consisting of sand having a particle size below 1 mm are fed to the trough 1 in order to start up the process.

Advantages afforded by the invention reside in that the process gases are cooled by means of relatively small heat exchanger surfaces and with the use of additional gas at a low rate the formation of crusts and a sulfatizing is avoided.

If the preceding unit is shut down so that the supply of process gas is interrupted, a falling of solids from the fluidized bed into the preceding units can be prevented in that the flow rate of the fluidizing gas is reduced or shut down.

It will be understood that the specification and examples are illustrative but not limitative of the present invention and that other embodiments within the spirit and scope of the invention will suggest themselves to those skilled in the art.

We claim:

1. A process of cooling a hot process gas, comprising: feeding the process gas through a central opening into a stationary fluidized bed which contains cooling elements and is contained in an annular trough; introducing fluidizing gas into the fluidized bed through a gas-permeable bottom of the trough; flowing cooled solids into the process gas stream over an inner rim of the trough whereby said cooled solids are entrained in said process gas stream into a dust-containing space over the top surface of the fluidized bed, at least a part of the solids suspended in the gas stream are separated in the dust-containing space over the fluidized bed and fall back into the annular fluidized bed; feeding the cooled gas which contains the remaining solids into a gas cooler which comprises cooling surfaces; introducing the gas leaving the upper portion of the gas cooler into a solids separator; removing solids in the separator and recycling at least a portion thereof to the stationary fluidized bed.

2. The process of claim 1 wherein the suspension density in the stationary fluidized bed is 300 to 1500 $kg/m^3$ of the empty volume of the first space.

3. The process of claim 2 wherein the suspension density if 500 to 1000 $kg/m^3$.

4. The process of claim 1 wherein solids are supplied from the stationary fluidized bed to the process gas stream at a rate of 1 to 10 $kg/m^3$ of process gas.

5. The process of claim 4 wherein the rate is 2.5 to 6 $kg/sm^3$.

6. The process of claim 1 wherein the gas leaving the gas cooler contains solids in an amount of 0.1 to 1 $kg/m^3$.

7. The process of claim 6 wherein the gas contains solids in an amount of 0.2 to 0.6 $kg/sm^3$.

8. The process of claim 1 wherein the standard volume rate of the fluidizing gas which enters the stationary fluidized bed through the permeable bottom is 10 to 30% of the standard volume rate of the process gas.

9. The process of claim 8 wherein the rate is 15 to 20%.

10. A process for cooling a hot process gas comprising: feeding a hot process gas into a means housing a stationary fluidized bed in a first space which is in the form of an annular trough with a rim, said means containing cooling solids and a cooling element in the first space; passing a fluidized gas into the first space to fluidize the cooling solids and cause said solids to flow over said rim for introduction into the process gas; entraining the cooling solids in said process gas whereby heat is transferred from the process gas to said cooling solids to obtain a first cooled gas; separating at least a portion of the solids from the first cooled gas in a space over the top surface of the fluidized bed so that at least a portion of the solids removed in the space re-enter the fluidized bed; passing the first cooled gas which contains remaining solids through a gas cooler; introducing the gas leaving the gas cooler into a solids separator; removing at least a portion of the solids in the separator; and recycling at least a portion of the removed solids to the stationary fluidized bed.

11. The process of claim 10 wherein the process gas is introduced in the vessel through a central opening.

12. The process of claim 10 wherein the gas cooler is equipped with a cooling surface.

13. The process of claim 10 wherein the trough has a gas permeable bottom.

14. The process of claim 10 wherein the suspension density in the stationary fluidized bed is 300 to 1500 $kg/m^3$ of the empty volume of the first space.

15. The process of claim 10 wherein solids are supplied from the stationary fluidized bed to the process gas stream at a rate of 1 to 10 $kg/m^3$ of process gas.

16. The process of claim 10 wherein the solids removed in the solids separator are recycled at a controlled rate to the stationary fluidized bed.

17. The process of claim 10 wherein the stationary fluidized bed has a central opening insulated by a refractory lining.

18. The process of claim 10 wherein the solids used to form the fluidized bed are suitable for being processed further together with any materials which have been removed from the exhaust gas.

19. The process of claim 10 further comprising introducing the solids separated in the solid separator into a buffer vessel.

* * * * *